US007527359B2

(12) United States Patent
Stevenson et al.

(10) Patent No.: US 7,527,359 B2
(45) Date of Patent: May 5, 2009

(54) CIRCUITRY FOR PRINTER

(75) Inventors: James M. Stevenson, Tualatin, OR (US); John R. Andrews, Fairport, NY (US); Bradley J. Gerner, Rochester, NY (US); Chad J. Slenes, Sherwood, OR (US); Jonathan R. Brick, Tualatin, OR (US)

(73) Assignee: Xerox Corporation, Norwalk, CT (US)

( * ) Notice: Subject to any disclaimer, the term of this patent is extended or adjusted under 35 U.S.C. 154(b) by 418 days.

(21) Appl. No.: 11/322,047

(22) Filed: Dec. 29, 2005

(65) Prior Publication Data

US 2007/0153069 A1 Jul. 5, 2007

(51) Int. Cl.
*B41J 2/04* (2006.01)

(52) U.S. Cl. ..... 347/54

(58) Field of Classification Search ..... 347/9, 347/10, 40, 54, 57, 65, 68
See application file for complete search history.

(56) References Cited

U.S. PATENT DOCUMENTS

| | | | | |
|---|---|---|---|---|
| 5,132,707 | A * | 7/1992 | O'Neill | 347/65 |
| 6,145,966 | A * | 11/2000 | Hotomi et al. | 347/70 |
| 6,332,669 | B1 * | 12/2001 | Kato et al. | 347/54 |
| 6,386,682 | B1 * | 5/2002 | Kimura | 347/54 |
| 6,394,586 | B2 * | 5/2002 | Isshiki | 347/54 |
| 7,004,555 | B2 * | 2/2006 | Sugahara | 347/9 |

* cited by examiner

*Primary Examiner*—Anh T. N. Vo
(74) *Attorney, Agent, or Firm*—Marger Johnson & McCollom, P.C.

(57) ABSTRACT

A print head has an array of jets formed in a jet stack to deliver ink to an image receptor and at least one ink reservoir to deliver ink to the jet stack. Control circuitry is arranged on the jet stack with an actuator array arranged on the control circuitry to cause the reservoir to deliver ink in response to signals from the control circuitry. A ground plane is arranged between the actuators and the ink reservoir. A print head has an array of jets formed into a jet stack to deliver ink to a printing medium and an actuator array formed on the jet stack, each actuator separated from other actuators by gaps. A spacer is arranged on the jet stack so as to fill the gaps between the actuators.

13 Claims, 5 Drawing Sheets

CIRCUITRY FOR PRINTER

BACKGROUND

Ink jet printers generally have print heads that direct droplets or otherwise transfer ink from ink reservoirs to a print medium, such as paper. In some instances the print heads have arrays of jets that direct droplets of the ink onto the medium. The jets produce drops of ink from the reservoirs when actuated. The actuator may be one of several different types that cause the jet to dispense ink. Examples include piezoelectric transducers that deflect against a membrane to force a drop of ink through the jet, or a small heater to temporarily vaporize ink into a bubble that forces ink through the jet.

The print head may be configured in several different ways.

SUMMARY

In one embodiment, a print head has an array of jets formed in a jet stack to deliver ink to an image receptor and at least one ink reservoir to deliver ink to the jet stack. Control circuitry is arranged on the jet stack with an actuator array arranged on the control circuitry to cause the reservoir to deliver ink in response to signals from the control circuitry. A ground plane is arranged between the actuators and the ink reservoir.

In another embodiment, a print head has an array of jets formed into a jet stack to deliver ink to a printing medium and an actuator array formed on the jet stack, each actuator separated from other actuators by gaps. A spacer is arranged on the jet stack so as to fill the gaps between the actuators.

DETAILED DESCRIPTION

Figure 1:
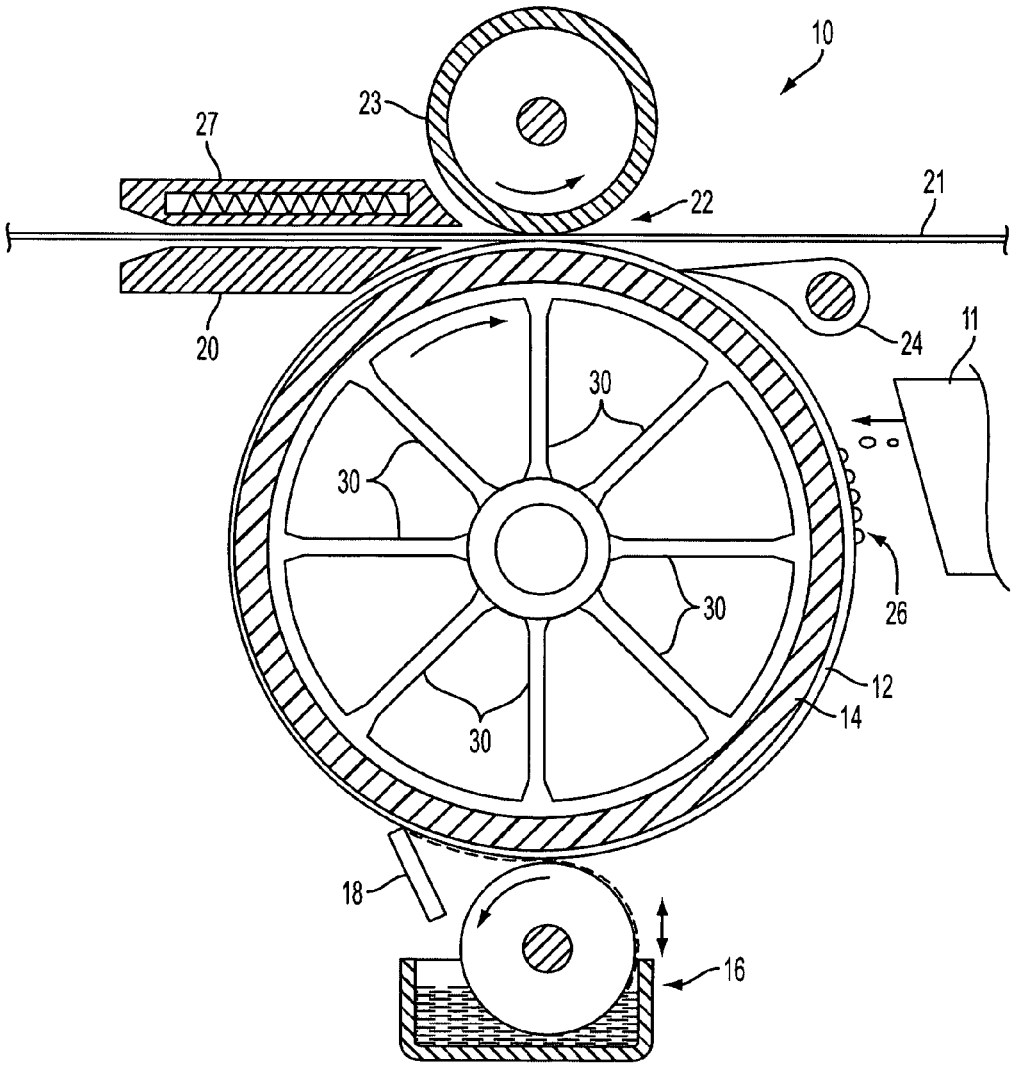
FIG. 1 shows a print head in a printing system.

FIG. 1 shows an example of a printer 10. The term printer as used here applies to any print engine, whether it is part of a printer, copier, fax machine, scanner or a multi-function device that has the capability of performing more than one of these functions. The printer has a print head 11 that deposits ink dot 26 on an intermediate transfer surface 12 to form an image. The supporting surface 14, such as a drum having spokes 30, supports the intermediate transfer surface 12. The intermediate transfer surface 12 may be a liquid applied to the supporting surface 14 by an applicator, web, wicking apparatus, metering blade assembly 18 from a reservoir 16.

The ink dots 26 form an image that is transferred to a piece of media 21 that is guided past the intermediate transfer surface by a substrate guide 20, and a media pre-heater 27. In solid ink jet systems, the system pre-heats the ink and the media prior to transferring the image to the media in the form of the ink dots. A pressure roller 23 transfers and fixes (transfixes) the ink dots onto the media at the nip 22. The nip is defined as the contact region between the roller and the intermediate transfer surface. It is the region in which the pressure roller compresses the media against the intermediate transfer surface which achieves the transfer of the image. One or more stripper fingers, such as 24, may assist in lifting the media away from the intermediate transfer surface.

The print head 11 may comprise an ink jet print head. Generally, ink jet print heads have an array of individual nozzles, ink delivery outlets, etc., referred to here as jets. These jets cause ink to be transferred from the print head to the print media directly, or through an intermediate transfer surface and then to the print media. For ease of discussion, the surface receiving the ink drops to form an image will be referred to here as an image receptor. The jets are organized into an array, referred to here as a jet stack.

The jet stack generally will have an array of actuators or transducers arranged on it so as to cause the jets to deliver ink. These transducers may be of many different types, including piezoelectric transducers. A piezoelectric transducer may vibrate or otherwise move a diaphragm against a reservoir of ink, causing the ink to be forced out of the ink jet onto the image receptor.

Issues may arise in mounting the actuator array to the jet stack. Excess epoxy adhesive used to attach the actuator array may flow into areas on the jet stack designated for ink ports and bonds pads for the control circuitry. This may cause problems in later processing of the jet stack. It should be noted that the term 'jet stack' is used to refer to the jet stack itself, and the jet stack and attached structures not including the ink manifold.

In addition, because the actuators stand above the plane of the jet stack, any further processing that involves pressing down on the actuator array to bond structures to the jet stack may result in uneven pressure being applied. For example, an elastomer pad may be used to bond the actuator array to the jet stack. Pressure applied to the pad may be unevenly distributed because of the protruding actuator array. This results in variations in bond quality that may affect the mechanical response of the actuator, resulting in actuators having varied responses across the array. This in turn degrades the uniformity of printing across the array of jets.

In one embodiment, a spacer is attached to the actuator array coplanar with the actuator, to form a uniform planarized layer referred to here as the actuator layer. The planarized layer may be referred to as an approximate plane, as the surface may not be exactly planar. The spacer is formed to allow windows or openings to accommodate the actuators in the array. This process may be better understood with regard to FIGS. 2-4.

Figure 2:
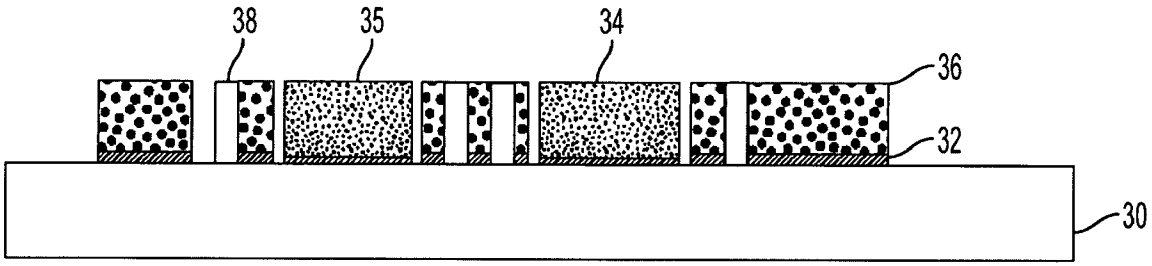
FIGS. 2-4 show an embodiment of a process of building a print head.

FIG. 2 shows a side view of a jet stack 30. The jet stack is an array of jets to dispense ink formed into an array. In one embodiment, the jet stack is a set of metal plates. The array of actuators such as 34 and 35 is bonded to the jet stack using an adhesive such as 32. Also bonded to the jet stack is a spacer 36 that is coplanar with the actuator array. The actuator array and spacer form the actuator layer which has a planarized surface opposite the surface that is bonded to the jet stack. Ink ports such as 38 allow ink to flow through the actuator layers, as will be demonstrated in more detail later.

Figure 3:
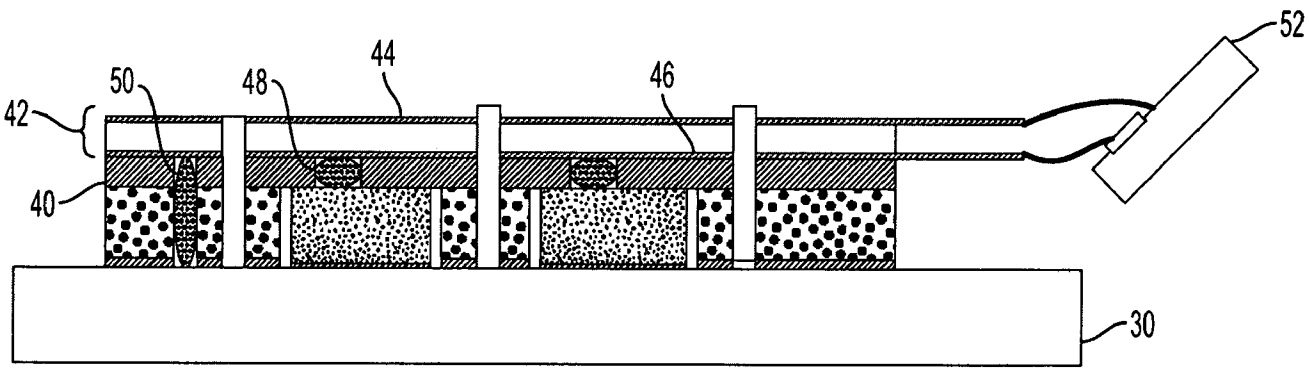

The presence of the spacer material prevents the adhesive from 'escaping' into the port holes and onto the contact pads. The planarized surface also provides a uniform surface for pressure bonding, resulting in more uniform bond quality for the actuators. In addition, other structures that may be attached in later processing may be bonded more robustly because of the uniformity of the surface. As shown in FIG. 3, a circuit substrate 42 may be attached to the surface of the actuator layer to provide signals to the actuators from the drive circuitry 52.

The circuit substrate 42 may further comprise a signal plane 44 to provide drive signals to the actuators, and a ground plane 46. Electrical connections may be made through drops of conductive paste such as 48 that are dispensed through holes in a standoff 40. The holes may include grounding vias that align with holes in the spacer material to provide connection between the jet stack 30 and the ground plane 46 through a drop of conductive paste such as 50.

Figure 4:
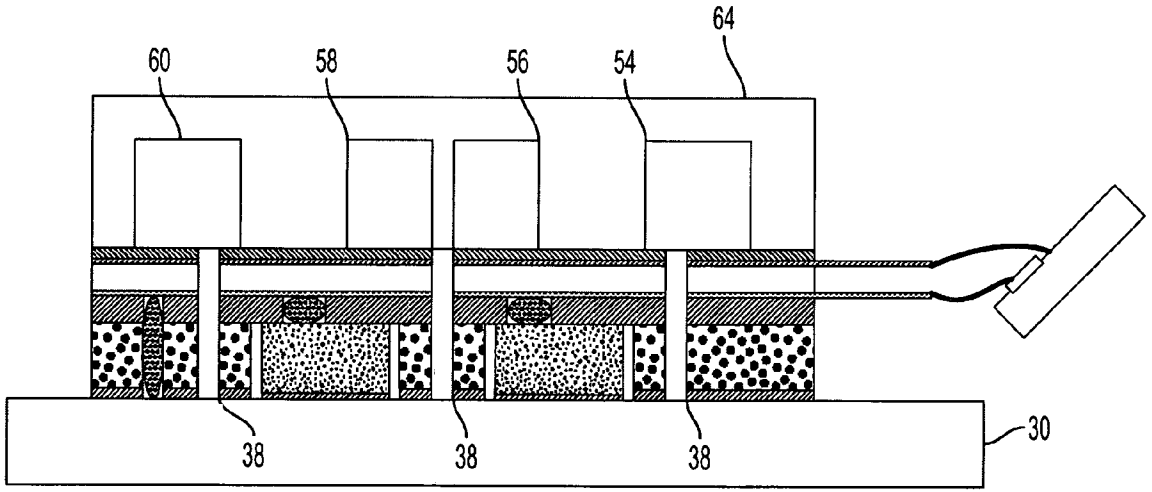

FIG. 4 shows the resulting print head that is completed by the ink manifold 64. The ink manifold may be attached by manifold adhesive 62 such that the ink ports 38 provided in the jet stack align with the ink reservoirs 54, 56, 58 and 60. It must be noted that variations and modifications of this process are possible and the examples given above are only examples and not intended to limit the scope of the claims in any way.

Figure 5:
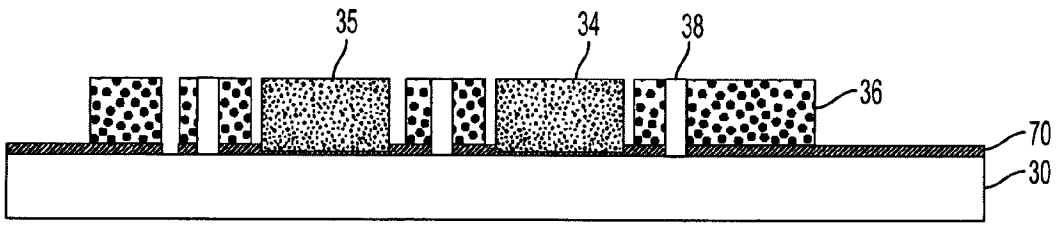
FIGS. 5-7 show an alternative embodiment of a process of building a print head.
Figure 6:
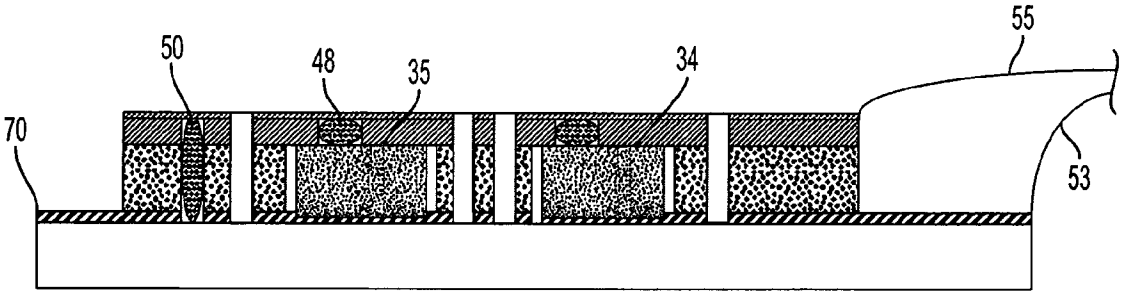
Figure 7:
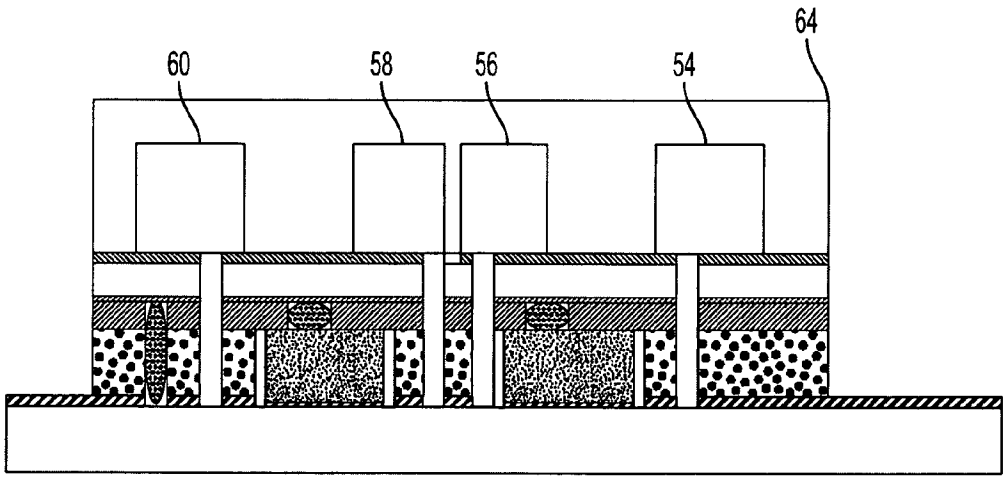

For example, the drive circuitry does not necessarily have to be attached on top of the planarized actuator layer surface. It is possible to form the drive circuitry on the surface of the jet stack itself. An alternative embodiment is shown in FIGS. 5-7. In FIG. 5, a jet stack is again provided as it was in FIG. 2, but the jet stack in this embodiment has formed upon its surface the drive circuitry for providing signals to the actuator arrays.

Formation of the circuitry may take many different paths. In one embodiment, the circuitry is formed in a conductive film, such as patterned aluminum foil, or a metallized polymer film. A specific example would be aluminized polyimide. In one embodiment, the film is deposited and then patterned to form the desired circuit structures. Upon formation of the circuit structures, the actuator layer of the spacer 36 and the actuators such as 34 and 35 is attached, and ink ports 38 established.

With the drive circuitry 'below' or 'under' the actuator, as oriented in the drawing, should have a ground plane. The ground plane may be arranged on the planarized surface of the actuator layer formed from the actuator array and the spacer. FIG. 6 shows an embodiment of this arrangement.

In FIG. 6, a standoff 40 is attached to the planarized surface of the actuator layer. The standoff 40 has holes through which may be applied a conductive paste such as that shown by 48. The ground plane 46 is then attached using the conductive paste. The ground plane may be a thin metal sheet, as an example. The conductive paste provides connectivity between the ground plane 46 and the drive circuitry 70 through connection 50, for example, and completes the circuit for providing signals to the actuators such as 34 and 35. The connection wires 55 and 53 connect the circuitry to the drive circuitry on board 52, shown previously.

FIG. 7 shows an embodiment of a completed print head with the attached ink manifold 64. The ink manifold contains the ink reservoirs 54, 56, 58 and 60, aligned with the ink ports as discussed previously.

Figure 8:
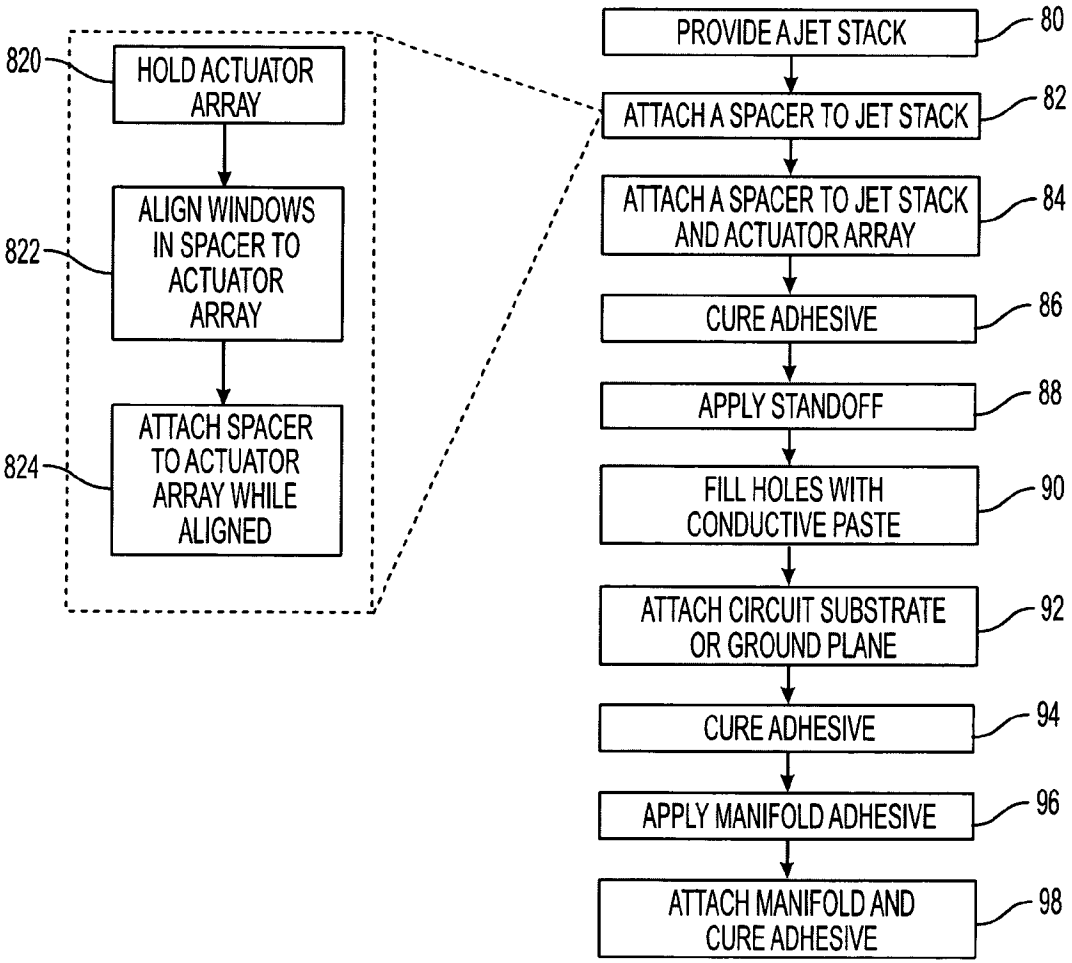
FIG. 8 shows a flow chart of an embodiment of a method of building a print head.

In this manner, a print head is provided that has a planarized actuator layer and has circuitry connections to allow the print head to receive drive signals from drive circuitry. A more detailed view of the processing flow is shown in flow chart form in FIG. 8. As discussed above, the process begins with a jet stack at 80. The jet stack may include the circuitry discussed with regard to FIGS. 5-7 above, or with regard to FIGS. 2-4 above. If the jet stack includes the circuitry discussed above, the conductive film is attached to the jet stack and the film is patterned to form the circuitry.

At 82, the spacer is attached to the jet stack. This may be accomplished in several different ways. In one embodiment, the actuator array may be held by a vacuum chuck, as shown at 820. The adhesive used as the spacer may be cut, such as by a laser or die cut, to form the windows to accommodate the actuator array, which is then aligned to the actuator array at 822. The spacer may be an adhesive sheet, for example, having liners to prevent adhesion until desired. The windows may be cut and peeled away from the spacer. The spacer may have one window for the entire actuator array, or several windows to accommodate sub arrays or portions of the actuator array.

At 824, the spacer is applied to the actuator array while the window or windows is/are aligned. This results in the actuator array or sub arrays residing in the window or windows when the attachment is complete. The spacer may be bonded to the jet stack by dispensing adhesive in predetermined areas of the jet stack, merging the two and then pressing the spacer to the jet stack.

The actuator layer, formed from the spacer and the actuator array, may then be bonded to the jet stack as one piece at 84. A standoff, such as that shown at 40 in FIG. 3 is then applied at 88. The standoff has holes in it corresponding to the actuators in the actuator array and at least one hole to accommodate a ground path. These holes are filled with conductive paste at 90.

As noted above, the control circuitry may be on the surface of the jet stack. If the embodiment is that of the circuitry formed on the jet stack such as that shown in FIGS. 5-7, the ground plane is then aligned with the dots of conductive paste and attached at 92.

If the embodiment is that of the circuitry being attached after the standoff, shown in FIGS. 2-4, the circuit substrate is attached at 92. The adhesive used to attach the ground plane or the control circuitry depending upon the embodiment is then cured at 94. The manifold adhesive is then applied at 96, the manifold attached and the adhesive cured at 98 to complete the jet stack.

In this manner, the print head is formed having reliable and robust mechanical and electrical connections. It will be appreciated that various of the above-disclosed and other features and functions, or alternatives thereof, may be desirably combined into many other different systems or applications. Also that various presently unforeseen or unanticipated alternatives, modifications, variations, or improvements therein may be subsequently made by those skilled in the art which are also intended to be encompassed by the following claims.

The invention claimed is:

1. A print head, comprising:

an array of jets formed in a jet stack to deliver ink to an image receptor;

at least one ink reservoir to deliver ink to the jet stack;

a control circuitry arranged on the jet stack;

an actuator array arranged on the control circuitry formed into an actuator layer to cause the reservoir to deliver ink in response to signals from the control circuitry;

a standoff arranged on the actuator layer, the standoff having an array of hole corresponding to the actuators, the holes filled with a conductive adhesive to connect the actuator array to the control circuitry; and a ground plane arranged on a face of the actuator array opposite the control circuitry.

2. The print head of claim 1, the print head farther comprising a spacer layer coplanar with the actuator layer.

3. The print head of claim 2, the spacer layer further comprising a polymer film attached to the jet stack.

4. The print head of claim 1, further comprising a connection between the ground plane and the control circuitry.

5. The print head of claim 4, the connection further comprising a portion of conductive adhesive.

6. The print head of claim 1, the print head further comprising ink ports from the ink reservoirs in the control circuitry, a spacer layer and the actuator array to allow the flow of ink from the ink reservoirs to the jet stack.

7. A method of manufacturing a print head, comprising processes of:

providing a jet stack formed from an array of jets, the jet stack having a control circuitry formed on a surface of the jet stack;

attaching a spacer layer to an actuator array to form an actuator layer;

bonding the actuator layer to the jet stack;

applying a standoff to the actuator layer and the spacer layer on the jet stack, the standoff having an array of holes corresponding to the actuator array and a having a hole for the ground plane;

filling the holes with a conductive adhesive;

curing the conductive adhesive to form conductive paths between the actuator array and the control circuitry and between the ground plane and a ground path;

aligning a ground plane with the jet stack; and bonding the ground plane to the jet stack.

8. The method of claim 7, wherein attaching a spacer layer comprises:

forming at least one window in the spacer layer to accommodate the actuator array;

aligning the spacer layer with the actuator array; and depositing the spacer layer onto the actuator array on the carrier to form the actuator layer.

9. The method of claim 7, wherein attaching a spacer layer comprises attaching a spacer layer having fluid port holes.

10. The method of claim 7, wherein bonding the actuator layer to the jet stack comprises:

dispensing adhesive into predetermined areas of the jet stack;

merging the actuator layer and the jet stack; and pressing the actuator layer and the jet stack to form a print head.

11. The method of claim 7, wherein forming control circuitry comprises:

attaching a conductive film to the surface of the jet stack; and patterning the conductive film to form control circuitry.

12. The method of claim 7, the method further comprising processes of attaching a substrate containing the control circuitry to control actuators to the jet stack.

13. The method of claim 12, wherein attaching the substrate comprises attaching one either a flexible circuit or a printed circuit board to the jet stack.

* * * * *